US006992028B2

(12) United States Patent
Thomaschefsky et al.

(10) Patent No.: US 6,992,028 B2
(45) Date of Patent: Jan. 31, 2006

(54) MULTI-LAYER NONWOVEN FABRIC

(75) Inventors: Craig F. Thomaschefsky, Marietta, GA (US); Lawrence M. Brown, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 183 days.

(21) Appl. No.: 10/237,455

(22) Filed: Sep. 9, 2002

(65) Prior Publication Data

US 2004/0048542 A1 Mar. 11, 2004

(51) Int. Cl.
*D04H 1/54* (2006.01)
*D04H 3/14* (2006.01)
*D04H 5/06* (2006.01)

(52) U.S. Cl. ..... 442/411; 442/381; 442/389; 442/409; 442/413; 442/415; 442/416; 442/408; 428/198

(58) Field of Classification Search ..... 442/381, 442/389, 409, 411, 413, 415, 416, 408; 428/198
See application file for complete search history.

(56) References Cited

U.S. PATENT DOCUMENTS

| | | | |
|---|---|---|---|
| 2,666,369 | A | 1/1954 | Niks |
| 3,485,706 | A | 12/1969 | Evans |
| 3,821,068 | A | 6/1974 | Shaw |
| 3,844,869 | A | 10/1974 | Rust, Jr. |
| 3,939,033 | A | 2/1976 | Grgach et al. |
| 3,949,130 | A | 4/1976 | Sabee et al. |
| 4,100,324 | A | 7/1978 | Anderson et al. |
| 4,259,399 | A | 3/1981 | Hill |
| 4,297,410 | A | 10/1981 | Tsuchiya et al. |
| 4,333,464 | A | 6/1982 | Nakano |
| 4,340,556 | A | 7/1982 | Ciencewicki |
| 4,426,417 | A | 1/1984 | Meitner et al. |
| 4,578,068 | A | 3/1986 | Kramer et al. |
| 4,604,313 | A | 8/1986 | McFarland et al. |
| 4,902,559 | A | 2/1990 | Eschwey et al. |

(Continued)

FOREIGN PATENT DOCUMENTS

EP 0865755 A1 9/1998

(Continued)

OTHER PUBLICATIONS

ASTM Designation: D 2724-87, (Reapproved 1995), "Standard Test Methods for Bonded, Fused, and Laminated Apparel Fabrics", Published Sep. 1987, pp. 660-666.

(Continued)

*Primary Examiner*—Norca L. Torres-Velazquez
(74) *Attorney, Agent, or Firm*—Nathan P. Hendon; Richard M. Shane

(57) ABSTRACT

A nonwoven fabric includes a first composite layer that includes from about 50% to about 90% by weight non-thermoplastic absorbent staple fibers and from about 10% to about 50% by weight thermoplastic fibers. A preponderance of the fibers at a first outer surface of the first composite layer comprise non-thermoplastic absorbent staple fibers and a preponderance of the fibers at a second outer surface of the first composite layer comprise thermoplastic fibers. The nonwoven fabric further includes a second composite layer that includes from about 50% to about 90% by weight non-thermoplastic absorbent staple fibers and from about 10% to about 50% by weight thermoplastic fibers. The second composite layer is adjacent the second outer surface of the first composite layer. The nonwoven fabric further includes bonded regions wherein a portion of the thermoplastic fibers of the first composite layer are fused to a portion of the thermoplastic fibers of the second composite layer, and further wherein the bonded regions have a plurality of contiguous voids.

16 Claims, 4 Drawing Sheets

U.S. PATENT DOCUMENTS

| | | | | |
|---|---|---|---|---|
| 5,096,532 | A | 3/1992 | Neuwirth et al. | |
| 5,110,403 | A | 5/1992 | Ehlert | |
| 5,137,600 | A | 8/1992 | Barnes et al. | |
| 5,223,319 | A | 6/1993 | Cotton et al. | |
| 5,284,703 | A | 2/1994 | Everhart et al. | |
| 5,389,202 | A | 2/1995 | Everhart et al. | |
| 5,508,102 | A | 4/1996 | Georger et al. | |
| D369,907 | S | 5/1996 | Sayovitz et al. | |
| 5,665,082 | A * | 9/1997 | Boulanger | 604/365 |
| 5,817,199 | A | 10/1998 | Brennecke et al. | |
| 6,022,818 | A * | 2/2000 | Welchel et al. | 442/384 |
| D428,267 | S | 7/2000 | Romano, III et al. | |
| D428,710 | S | 8/2000 | Romano, III et al. | |
| 6,103,061 | A | 8/2000 | Anderson et al. | |
| 6,534,174 | B1 | 3/2003 | Ouellette et al. | |
| 2001/0036787 | A1 * | 11/2001 | Brennan | 442/361 |
| 2004/0026012 | A1 * | 2/2004 | Kato et al. | 156/180 |

FOREIGN PATENT DOCUMENTS

| | | |
|---|---|---|
| GB | 2151272 A | 7/1985 |
| WO | WO 96/41045 | 12/1996 |
| WO | WO 98/03713 | 1/1998 |
| WO | WO 01/79599 A2 | 10/2001 |

OTHER PUBLICATIONS

ASTM Designation: D 1117-99, "Standard Guide for Evaluating Nonwoven Fabrics", Published Jan. 2000, pp. 264-266.

ASTM Designation: D 3884-92, "Standard Test Method for Abrasion Resistance of Textile Fabrics (Rotary Platform, Double-Head Method)", Published Aug. 1992, pp. 158-162.

ASTM Designation: D 3776-96, "Standard Test Method for Mass Per Unit Area (Weight) of Fabric", Published Jun. 1996, pp. 86-89.

ASTM Designation: D 5034-95, "Standard Test Method for Breaking Strength and Elongation of Textile Fabrics (Grab Test)", Published Jul. 1995, pp. 674-681.

TAPPI Official Test Method T411 om-89, "Thickness (Caliper) of Paper, Paperboard, and Combined Board," published by the TAPPI Press, Atlanta, GA, revised 1989, pp. 1-3.

* cited by examiner

MULTI-LAYER NONWOVEN FABRIC

FIELD OF THE INVENTION

The present invention generally relates to the preparation and manufacture of nonwoven materials. More particularly, the present invention relates to the preparation and manufacture of nonwoven materials suitable for use as absorbent wipers.

BACKGROUND OF THE INVENTION

In many applications there is a need for a wiper having the capability to quickly absorb large quantities of both water and oil. Wipers desirably leave behind a clean surface that is also free of streaks. Preferably a wiper can be reused by wringing out the absorbed liquid. Wipers desirably have adequate strength and abrasion resistance to withstand such use without tearing, shredding or linting. Wipers desirably also have a feel that is agreeable to the touch, including softness and drapability.

There are many types of wipers available. Paper wipers are inexpensive, yet often are lacking in regard to absorbing oil based liquids. Cloth wipers, while adequately absorbing both water and oil, are expensive to manufacture and require laundering to make them cost-effective. Nonwoven wipers are inexpensive enough to be disposable, yet can be deficient in absorbance and feel when compared to cloth wipers.

Nonwoven composites of both hydrophilic and hydrophobic fibers that are both water and oil absorbent are known in the art. High basis weight wipers have absorbance capacities that approach those of cloth wipers. However, there remains a need to provide a nonwoven fabric for low cost nonwoven wipers having even greater absorbent capacity with improved tactile properties.

SUMMARY OF THE INVENTION

The aforementioned needs for an improved nonwoven wiper are addressed by the present invention which provides a highly absorbent nonwoven fabric. The nonwoven fabric includes a first composite layer that includes from about 50% to about 90% by weight non-thermoplastic absorbent staple fibers and from about 10% to about 50% by weight thermoplastic fibers. A preponderance of the fibers at a first outer surface of the first composite layer comprise non-thermoplastic absorbent staple fibers and a preponderance of the fibers at a second outer surface of the first composite layer comprise thermoplastic fibers. The nonwoven fabric further includes a second composite layer that includes from about 50% to about 90% by weight non-thermoplastic absorbent staple fibers and from about 10% to about 50% by weight thermoplastic fibers. The second composite layer is adjacent the second outer surface of the first composite layer. The nonwoven fabric further includes bonded regions wherein a portion of the thermoplastic fibers of the first composite layer are fused to a portion of the thermoplastic fibers of the second composite layer, and further wherein the bonded regions have a plurality of contiguous voids.

Desirably, the contiguous voids allow substantial flow of absorbed liquids within the bonded regions. In one aspect, the bonded regions comprise discrete bond points arranged in a pattern on the surface of the nonwoven fabric. In a further aspect, the bonded regions are ultrasonically bonded.

In one aspect, the bonded regions are substantially porous in the z-direction, i.e., the direction perpendicular to the surface of the nonwoven fabric. Desirably, the bonded regions are porous in the x- and y-directions, i.e., the directions parallel to the surface of the nonwoven fabric. Even more desirably, the bonded regions are substantially porous in all directions, i.e., the x-, y-, and z-directions.

In one aspect, the bonded regions provide sufficient strength to inhibit delamination of the layers during wiping applications. Peel strength is a test designed to measure the strength between layers that are bonded together. Desirably, the peel strength of the nonwoven fabric ranges from about 50 grams to about 500 grams, and, more desirably, the peel strength ranges from about 50 grams to about 300 grams. Desirably, the nonwoven fabric has a basis weight of from about 40 gsm to about 300 gsm.

In one aspect, the non-thermoplastic absorbent staple fibers comprise pulp fibers. In a further aspect, the thermoplastic fibers comprise substantially continuous filaments. Desirably, the thermoplastic fibers comprise substantially continuous polypropylene filaments.

In a further aspect, a preponderance of the fibers at a first outer surface of the second composite layer comprise non-thermoplastic absorbent staple fibers and a preponderance of the fibers at a second outer surface of the second composite layer comprise thermoplastic fibers. Desirably, the second outer surface of the second composite layer is adjacent the second outer surface of the first composite layer.

In another embodiment, a nonwoven fabric includes a first composite layer that includes non-thermoplastic absorbent staple fibers and thermoplastic fibers, a second composite layer that includes non-thermoplastic absorbent staple fibers and thermoplastic fibers wherein the second composite layer is adjacent the first composite layer, and bonded regions wherein a portion of the thermoplastic fibers of the first composite layer are fused to a portion of the thermoplastic fibers of the second composite layer, and further wherein the bonded regions have a plurality of contiguous voids.

Other features and aspects of the present invention are discussed in greater detail below.

BRIEF DESCRIPTIONS OF THE DRAWINGS

DEFINITIONS

Figure 1:
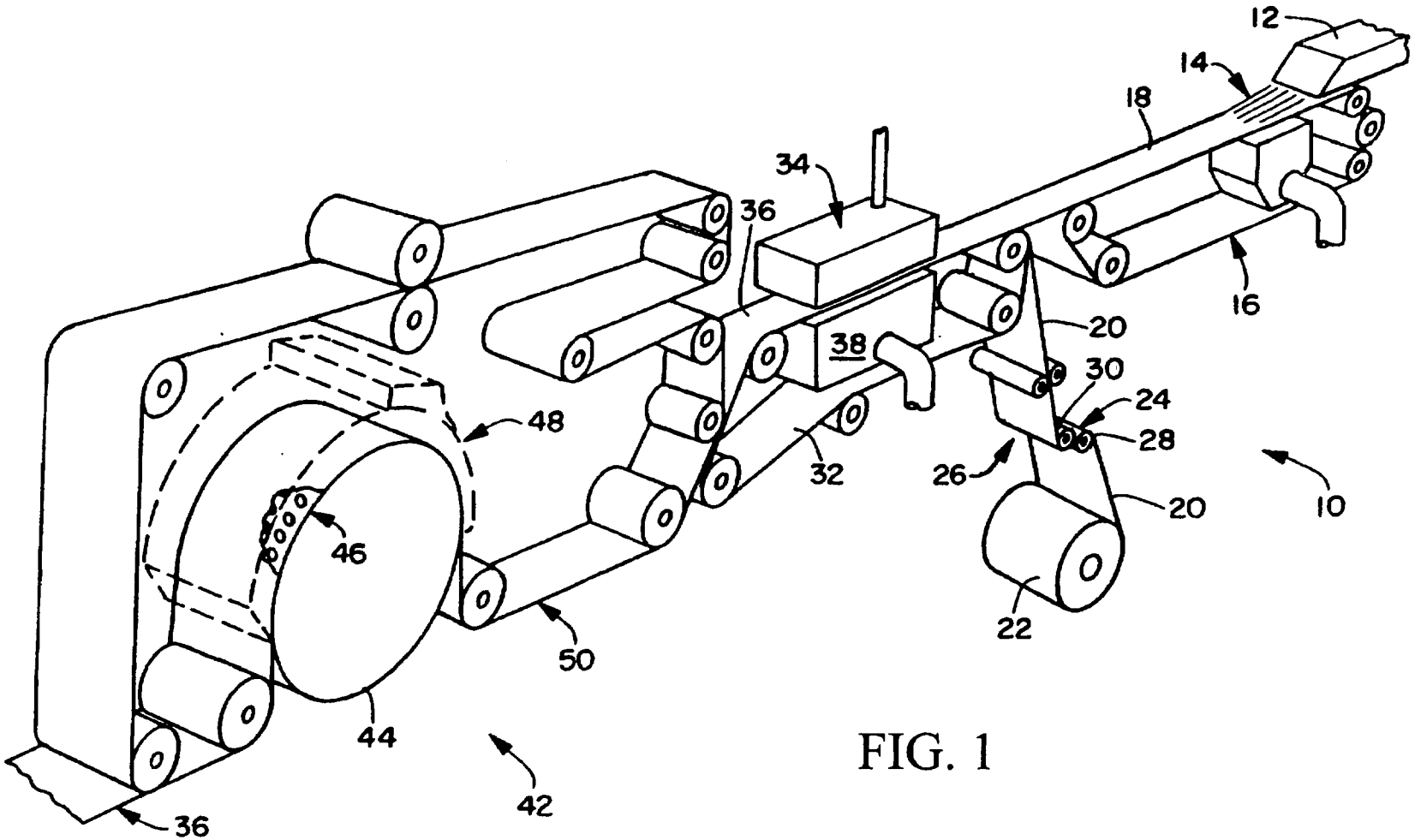
FIG. 1 is a schematic view of an exemplary process used to ply together layers of nonwoven materials.

The term "machine direction" as used herein refers to the direction of travel of the forming surface onto which fibers are deposited during formation of a nonwoven web.

The term "cross-machine direction" as used herein refers to the direction which is perpendicular to the machine direction defined above.

The term "staple fibers" as used herein refers to either natural fibers or cut lengths from filaments produced from conventional staple fiber spinning and drawing processes.

The term "pulp" as used herein refers to fibers from natural sources such as woody and non-woody plants. Woody plants include, for example, deciduous and coniferous trees. Non-woody plants include, for example, cotton, flax, esparto grass, milkweed, straw, jute, hemp, and bagasse.

As used herein, the term "substantially continuous" filaments or fibers refers to filaments or fibers prepared by extrusion from a spinneret, including without limitation spunbonded and meltblown fibers. Substantially continuous filaments or fibers may have average lengths ranging from greater than about 20 centimeters to more than one meter, and up to the length of the web or fabric being formed. Additionally and/or alternatively, the definition of "substantially continuous" filaments or fibers includes those which are not cut prior to being formed into a nonwoven web or fabric, but which are later cut when the nonwoven web or fabric is cut.

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of."

DETAILED DESCRIPTION

The invention will now be described in detail with reference to particular embodiments thereof. The embodiments are provided by way of explanation of the invention, and not meant as a limitation of the invention. For example, features described or illustrated as part of one embodiment may be used with another embodiment to yield still a further embodiment. It is intended that the present invention include these and other modifications and variations as come within the scope and spirit of the invention.

The present invention provides a nonwoven fabric that includes composite layers comprising non-thermoplastic absorbent staple fibers and thermoplastic fibers. The layers are attached to one another at bonded regions wherein thermoplastic fibers from each composite layer are fused to thermoplastic fibers from the other composite layer. The non-thermoplastic absorbent staple fibers and the thermoplastic fibers are desirably arranged such that a preponderance of the fibers at one surface of the composite layer are non-thermoplastic absorbent staple fibers while a preponderance of the fibers at the other surface are thermoplastic fibers. Desirably, the surfaces having a preponderance of thermoplastic fibers are adjacent one another so as to produce a nonwoven material with outer surfaces having a preponderance of the non-thermoplastic absorbent staple fibers.

The non-thermoplastic absorbent staple fibers of the composite layers may be of any average fiber length suitable for use in nonwoven forming processes including, but not limited to, conventional wet forming processes, air laying processes, carding processes, and so forth. As a nonlimiting example, the non-thermoplastic absorbent staple fibers may have an average fiber length from about 0.7 millimeters to about 25 millimeters. By way of nonlimiting example, pulp fiber is a non-thermoplastic absorbent staple fiber that is useful in the practice of the present invention. Other suitable staple fibers include, but are not limited to, acetate staple fibers, rayon staple fibers, Nomex® staple fibers, Kevlar® staple fibers, polyvinyl alcohol staple fibers, lyocell staple fibers, and so forth. Desirably, the non-thermoplastic absorbent staple fibers within a layer may have, for example, a basis weight from about 8 grams per square meter (gsm) to about 120 gsm. Even more desirably, the non-thermoplastic absorbent staple fibers within a layer have a basis weight from about 10 gsm to about 60 gsm.

The thermoplastic fibers of the composite layers may be formed by known nonwoven extrusion processes, such as, for example, known solvent spinning or melt-spinning processes, for example, spunbonding or meltblowing. The thermoplastic fibers may be staple fibers, or may be substantially continuous filaments.

The thermoplastic fibers may be formed from any solvent-spinnable or melt-spinnable thermoplastic polymer, co-polymers or blends thereof. Suitable polymers for the present invention include, but are not limited to, polyolefins, polyamides, polyesters, polyurethanes, blends and copolymers thereof, and so forth. Desirably, the thermoplastic fibers comprise polyolefins, and even more desirably the thermoplastic fibers comprise polypropylene and polyethylene. Suitable fiber forming polymer compositions may additionally have thermoplastic elastomers blended therein as well as contain pigments, antioxidants, flow promoters, stabilizers, fragrances, abrasive particles, filler and the like. Optionally, the thermoplastic fibers may be multicomponent fibers consisting of two or more different polymers. The thermoplastic fibers may be round or any the suitable shape known to those skilled in the art, including but not limited to, bilobal, trilobal, and so forth. Desirably, the thermoplastic fibers within a layer have a basis weight from about 8 to about 70 gsm. More desirably, the thermoplastic fibers have a basis weight from about 10 to about 35 gsm.

In a further aspect of the invention, the composite layers may contain various materials such as, for example, activated charcoal, clays, starches, and superabsorbent materials. For example, these materials may be added to the non-thermoplastic absorbent staple fibers prior to their incorporation into the composite layer. Alternatively and/or additionally, these materials may be added to the composite layer after the non-thermoplastic absorbent staple fibers and thermoplastic fibers are combined. Useful superabsorbents are known to those skilled in the art of absorbent materials. Superabsorbents are desirably present at a proportion of up to about 50 grams of superabsorbent per 100 grams of fibers in the composite layer.

It may be desirable to use finishing steps and/or post treatment processes to impart selected properties to the individual composite layers. For example, the composite layer may be subjected to mechanical treatments, chemical treatments, and so forth. Mechanical treatments include, by way of nonlimiting example, pressing, creping, brushing, and/or pressing with calender rolls, embossing rolls, and so forth to provide a uniform exterior appearance and/or certain tactile properties. Chemical post-treatments include, by way of nonlimiting example, treatment with adhesives, dyes, and so forth.

Examples of composite nonwoven materials that can be used as a layer to form the nonwoven materials of the present invention include, but are not limited to, materials such as those described in U.S. Pat. No. 4,100,324 to Anderson et al., U.S. Pat. No. 5,508,102 to Georger et al., and U.S. Pat. No. 4,902,559 to Eschwey et al., the contents of which are incorporated by reference herein in their entirety. Other exemplary materials include composites of thermoplastic fibers with absorbent staple fibers that are hydraulically entangled together such as are described in U.S. Pat. No. 5,284,703 to Everhart et al., the contents of which are incorporated by reference herein in their entirety.

Referring to FIG. 1 of the drawings there is schematically illustrated at 10 an exemplary process for forming a hydroentangled composite fabric that can be used to form at least one of the composite layers of the nonwoven material of the present invention. In this process, a suspension of non-thermoplastic absorbent staple fibers is supplied by a headbox 12 and deposited via a sluice 14 in a dispersion onto a forming fabric 16 of a conventional wet-forming machine. However, while reference is made herein to formation of a non-thermoplastic absorbent staple fiber web by wet-forming processes, it is to be understood that the non-thermoplastic absorbent staple fiber web could alternatively be manufactured by other conventional processes such as for example, carding, airlaying, drylaying, and so forth.

The suspension of staple fibers may be of any consistency that is typically used in conventional wet-forming processes. For example, the suspension may contain from about 0.01 to about 1.5 percent by weight staple fibers suspended in water. Water is removed from the suspension of staple fibers to form a uniform layer of staple fibers 18. The staple fiber layer 18 may have, for example, a dry basis weight from about 10 to about 120 grams per square meter (gsm). Desirably, the staple fiber layer 18 has a dry basis weight from about 10 to about 60 gsm.

In this embodiment, the staple fibers may be of any average fiber length suitable for use in conventional wet forming processes. By way of nonlimiting example, northern softwood Kraft pulp fiber is a staple fiber that is suitable for use in a wet forming process. As a nonlimiting example, the staple fibers may have an average fiber length from about 1.5 mm to about 6 mm. Desirable pulp fibers include those having lower average fiber lengths including, but not limited to, certain virgin hardwood pulps and secondary (i.e. recycled) fiber pulp from sources such as, for example, newsprint, reclaimed paperboard, office waste, and so forth. Pulp fibers from these sources typically have an average fiber length of less than about 1.2 mm, for example, from 0.7 mm to 1.2 mm. Other suitable staple fibers include, but are not limited to, acetate staple fibers, rayon staple fibers, and so forth.

When pulp fibers are used in the present invention, they may be unrefined or may be beaten to various degrees of refinement. Wet-strength resins and/or resin binders may be added to improve strength and abrasion resistance as desired. Useful binders and wet-strength resins are known to those skilled in the papermaking art. Cross-linking agents and/or hydrating agents may also be added to the pulp. Debonding agents may be added to the pulp to reduce the degree of hydrogen bonding if a very open or loose pulp fiber web is desired. Useful debonding agents are known to those skilled in the papermaking art. The addition of certain debonding agents also may reduce the static and dynamic coefficients of friction. The debonder is believed to act as a lubricant or friction reducer.

Referring again to FIG. 1 of the drawings, a thermoplastic fiber substrate 20 is unwound from a supply roll 22. The thermoplastic fiber substrate 20 passes through a nip 24 of an S-roll arrangement 26 formed by the stack rollers 28 and 30. In an alternate embodiment (not shown) the nonwoven substrate could be made in-line prior to being directed to the nip 24. The precise arrangement of the rollers is not critical to the present invention.

The thermoplastic fiber substrate 20 may have a basis weight from about 10 to about 70 gsm. Desirably, the thermoplastic fiber substrate 20 may have a basis weight from about 10 to about 35 gsm. The polymers that comprise the thermoplastic fiber substrate may include additional materials such as, for example, pigments, antioxidants, flow promoters, stabilizers and so forth.

The thermoplastic fiber substrate 20 may be bonded prior to the hydroentangling process. Desirably, the thermoplastic fiber substrate 20 has a total bond area of less than about 30 percent and a uniform bond density greater than about 100 bonds per square inch. For example, the thermoplastic fiber substrate may have a total bond area from about 2 to about 30 percent and a bond density from about 250 to about 500 pin bonds per square inch. Such a combination total bond area and bond density may be achieved by bonding the thermoplastic fiber substrate with bonding rolls having various bond patterns. Although pin bonding produced by thermal bond rolls is described above, any form of bonding which produces good tie down of the filaments with minimum overall bond area can be used. For example, a combination of thermal bonding and latex impregnation may be used to provide desirable filament tie down with minimum bond area. Alternatively and/or additionally, a resin, latex or adhesive may be applied to the thermoplastic fiber substrate by, for example, spraying or printing, and dried to provide the desired bonding.

The staple fiber layer 18 is then laid on the thermoplastic fiber substrate 20 which rests upon a foraminous entangling surface 32 of a conventional hydraulic entangling machine. It is desirable that the staple fiber layer 18 is between the thermoplastic fiber substrate 20 and the hydraulic entangling manifolds 34. The staple fiber layer 18 and thermoplastic fiber substrate 20 pass under one or more hydraulic entangling manifolds 34 and are treated with jets of fluid to entangle the staple fibers with the thermoplastic fiber substrate 20. The jets of fluid also drive staple fibers into and through the thermoplastic fiber substrate 20 to form the composite material 36.

Alternatively, hydraulic entangling may take place while the staple fiber layer 18 and thermoplastic fiber substrate 20 are on the same foraminous screen (i.e., mesh fabric) upon which the wet-laying took place. Alternatively, a dried staple sheet can be superposed on a thermoplastic fiber substrate, re-hydrated to a specified consistency and then subjected to hydraulic entangling.

The hydraulic entangling may take place while the staple fiber layer 18 is highly saturated with water. For example, the staple fiber layer 18 may contain up to about 90 percent by weight water just before hydraulic entangling. Alternatively, the staple fiber layer may be an air-laid or dry-laid layer of staple fibers.

The hydraulic entangling may be accomplished utilizing conventional hydraulic entangling processes and equipment such as, for example, those found in U.S. Pat. No. 5,284,703 to Everhart et al., and U.S. Pat. No. 3,485,706 to Evans, the entire contents of which is incorporated herein by reference. The hydraulic entangling may be carried out with any appropriate working fluid such as, for example, water. The working fluid flows through a manifold that evenly distributes the fluid to a series of individual holes or orifices that may be, by way of nonlimiting example, from about 0.07 millimeters to about 0.4 millimeters in diameter. Many other manifold configurations and combinations known to those skilled in the art may be used. For example, a single manifold may be used or several manifolds may be arranged in succession.

In the hydraulic entangling process, the working fluid desirably passes through the orifices at a pressures ranging from about 1,300 to about 14,000 kPa. At the upper ranges of the described pressures it is contemplated that the composite fabrics may be processed at speeds of about 300 meters per minute. The fluid impacts the staple fiber layer 18 and the thermoplastic fiber substrate 20 which are supported by the foraminous entangling surface 32 which may be, for example, a single plane mesh having a mesh size of from about 40×40 to about 100×100. The foraminous entangling surface 32 may also be a multi-ply mesh having a mesh size from about 50×50 to about 200×200. As is typical in many water jet treatment processes, vacuum slots 38 may be located directly beneath the hydraulic entangling manifolds 34 or beneath the foraminous entangling surface 32 downstream of the hydraulic entangling manifold 34 so that excess water is withdrawn from the hydraulically entangled composite material 36.

The columnar jets of working fluid which directly impact the staple fibers laying on the thermoplastic fiber substrate work to drive those fibers into and partially through the matrix or nonwoven network of fibers in the thermoplastic fiber substrate. When the fluid jets and staple fibers interact with the thermoplastic fiber substrate, the staple fibers are entangled with fibers of the thermoplastic fiber substrate and with each other. The degree of entanglement that may be achieved is dependent upon the degree to which the thermoplastic fibers have been bonded together. If the thermoplastic fiber substrate is too loosely bonded, the filaments are generally too mobile to form a coherent matrix to secure the staple fibers. On the other hand, if the total bond area of the thermoplastic fiber substrate is too great, the staple fiber penetration may be poor. Moreover, too much bond area will also cause a non-uniform composite fabric because the jets of fluid will splatter, splash and wash off staple fibers when they hit the large non-porous bond spots. The appropriate levels of bonding, as described above, provide a coherent thermoplastic fiber substrate that may be formed into a fabric suitable for us as a composite layer in the nonwoven material of the present invention by hydraulic entangling on only one side and still provide a strong, useful fabric as well as a composite fabric having desirable dimensional stability.

The energy of the fluid jets that impact the staple fiber layer and the thermoplastic fiber substrate can be adjusted so that the staple fibers are inserted into and entangled with the continuous filament substrate in a manner that enhances the two-sidedness of the resulting composite layer. That is, the entangling can be adjusted to produce a material of which a preponderance of the fibers on one surface are non-thermoplastic absorbent staple fibers and a preponderance of the fibers on the opposite surface are thermoplastic fibers.

After the fluid jet treatment, the composite fabric 36 may optionally be transferred to a drying operation, desirably a non-compressive drying operation. If desired, the composite fabric may be wet-creped before being transferred to the drying operation. Non-compressive drying of the web may be accomplished utilizing a conventional rotary drum through-air drying apparatus shown in FIG. 1 at 42. The through-dryer 42 may be an outer rotatable cylinder 44 with perforations 46 in combination with an outer hood 48 for receiving hot air blown through the perforations 46. A through-dryer belt 50 carries the composite fabric 36 over the upper portion of the through-dryer outer cylinder 40. The heated air forced through the perforations 46 in the outer cylinder 44 of the through-dryer 42 removes water from the composite fabric 36. The temperature of the air forced through the composite fabric 36 by the through-dryer 42 may vary in accord with the line speed, percent saturation, atmospheric conditions, etc. The drying air may be heated or at ambient temperature. Other useful through-drying methods and apparatus may be found in, for example, U.S. Pat. No. 2,666,369 to Niks and U.S. Pat. No. 3,821,068 to Shaw, the entire contents of each of the aforesaid references being incorporated herein by reference.

Figure 2:
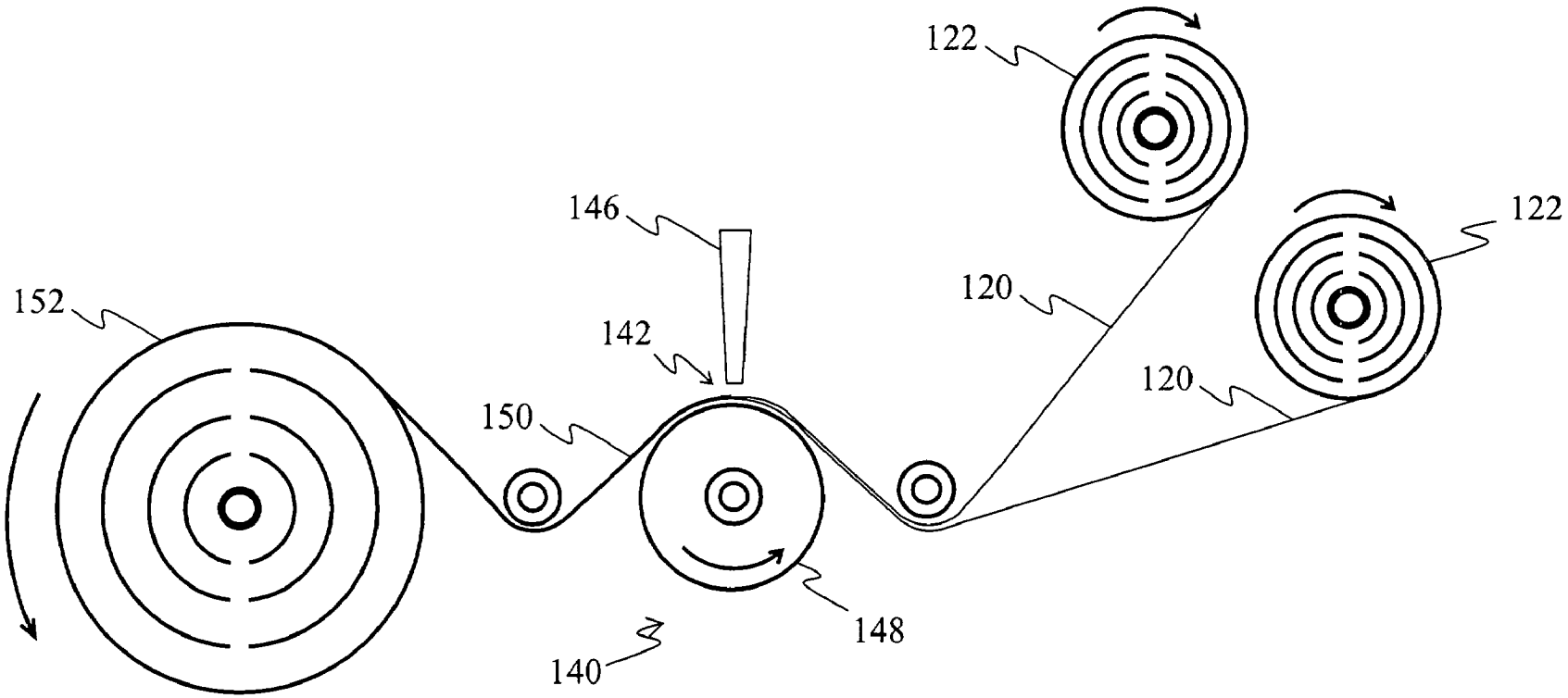
FIG. 2 is a schematic view of an exemplary process used to produce the plies of nonwoven materials.

The nonwoven fabric of the present invention can be produced, for example, according to the process depicted in FIG. 2. First and second composite layers 120, as described above, are unwound from first and second base rolls 122 and fed into a nip 142 of an ultrasonic laminator 140. The nip 142 of the ultrasonic laminator 140 is formed between a stationary ultrasonic horn 146 and a rotating patterned anvil roll 148. It is contemplated, however, that more than two composite layers may be plied together to form the nonwoven fabric of the present invention. The composite layers 120 are bonded together within the nip 142 to form a nonwoven fabric 150 that is then wound into a final base roll 152. Alternatively, the nonwoven material 150 that exits the ultrasonic laminator 140 may be transferred to subsequent converting steps such as slitting, embossing, debulking, rewinding, etc., that are well known to those skilled in the art.

Ultrasonic bonding by way of a stationary horn and a rotating patterned anvil roll are known in the art and are taught, for example, in U.S. Pat. Nos. 3,939,033 to GrGach et al., U.S. Pat. No. 3,844,869 to Rust Jr., and U.S. Pat. No. 4,259,399 to Hill, the entire contents of each of the aforesaid references being incorporated herein by reference. It is also contemplated that the materials of the present invention can be produced by using an ultrasonic bonding apparatus that includes a rotary horn with a rotating patterned anvil roll as is taught, for example, in U.S. Pat. Nos. 5,096,532 to Neuwirth et al., U.S. Pat. No. 5,110,403 to Ehlert, and U.S. Pat. No. 5,817,199 to Brennecke et al., the entire contents of each of the aforesaid references being incorporated herein by reference. However, while specific ultrasonic bonders have been identified above, still other bonders are believed suitable for use in the present invention.

The composite layers 120 that are plied together desirably have a sidedness as described above. One surface of each composite layer 120 has a preponderance of the thermoplastic fibers, giving it a slicker, more plastic-like feel, while the opposite surface has a preponderance of non-thermoplastic absorbent staple fibers, giving it a softer, more consistent feel. When laminating two of these composite layers together, it is desired that the surfaces having the preponderance of the thermoplastic fibers face the inside of the laminated structure, leaving the surfaces having the preponderance of the non-thermoplastic absorbent staple fibers to the outside. Juxtaposing the composite layers in this manner increases the contact between the thermoplastic fibers of the two layers, thus increasing the amount of bonding that occurs. It also leaves the surfaces having the preponderance of the non-thermoplastic absorbent staple fibers on the outsides of the laminate structure, resulting in increased opacity and improved visual aesthetics and hand feel in comparison to single ply structures. Positioning the composite layer surfaces having the preponderance of thermoplastic fibers within the interior of the laminate also allows use of non-pigmented thermoplastic fibers because the thermoplastic fibers are less visible after the composite layers are laminated together. Colored wipers can then be produced, for example, by dying only the non-thermoplastic absorbent staple fibers, resulting in reduced manufacturing costs.

Although the inventors do not wish to be held to a particular theory of operation, it is believed that the non-thermoplastic absorbent staple fibers present in the area of the bonded regions inhibit full melting of the thermoplastic fibers, thus preventing formation of a substantially polymer-filled bonded region as would occur during bonding of a web containing only thermoplastic fibers. Comparative bonded regions are provided in FIGS. 3 & 4. The samples in FIGS. 3 & 4 were immersed in liquid nitrogen and bisectioned along a row of bonded regions using a single edge razor. The bisections were evaluated in a field emission scanning electron microscope (FESEM) at low voltage (1.2 KV) without any conductive coating. Compositional (backscattered electron) images were produced using a microchannel plate detector with a negative bias voltage.

Figure 3:
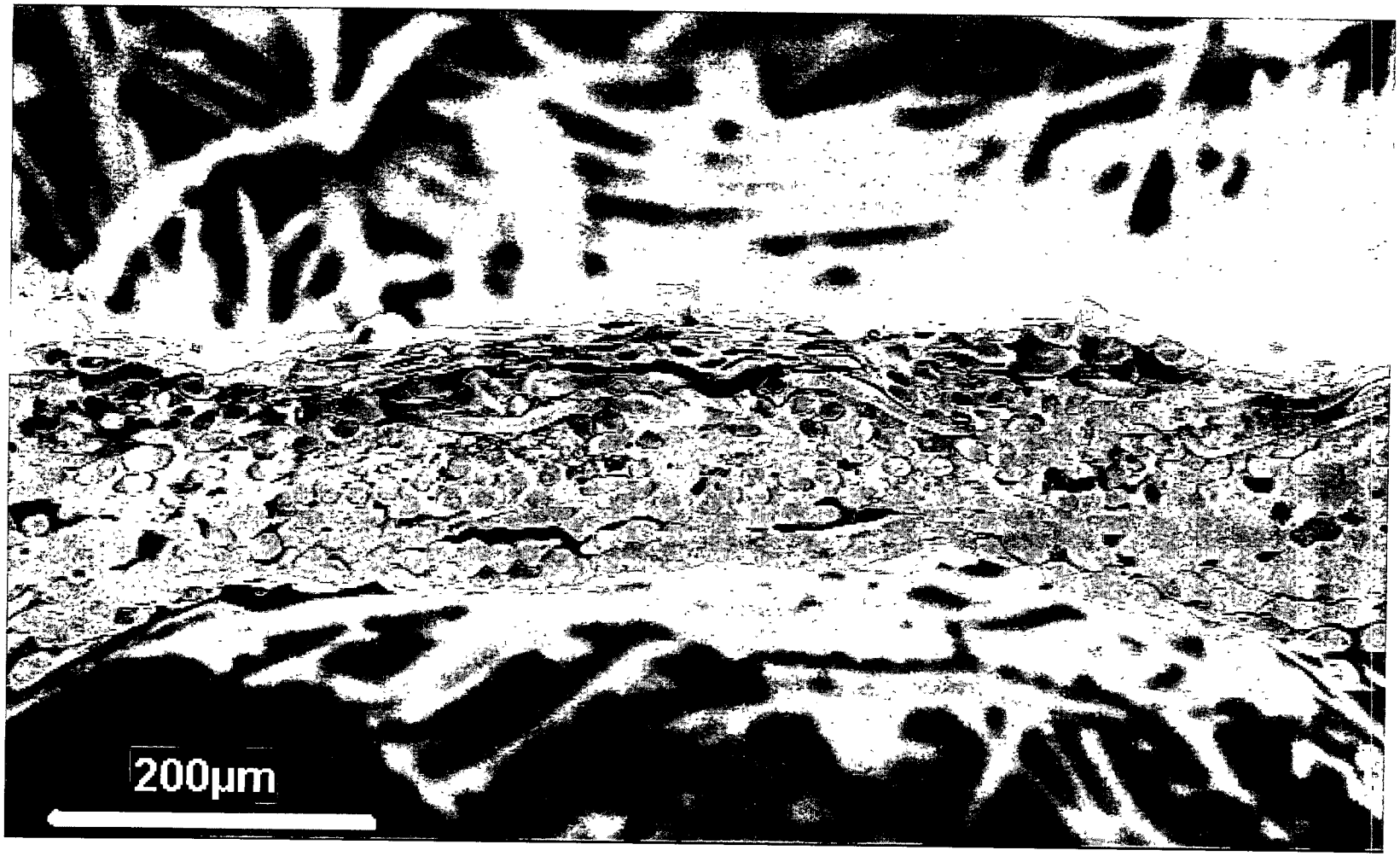
FIG. 3 is an SEM image of a cross-sectional view of an exemplary thermal bond between two plies of thermoplastic filaments.
Figure 4:
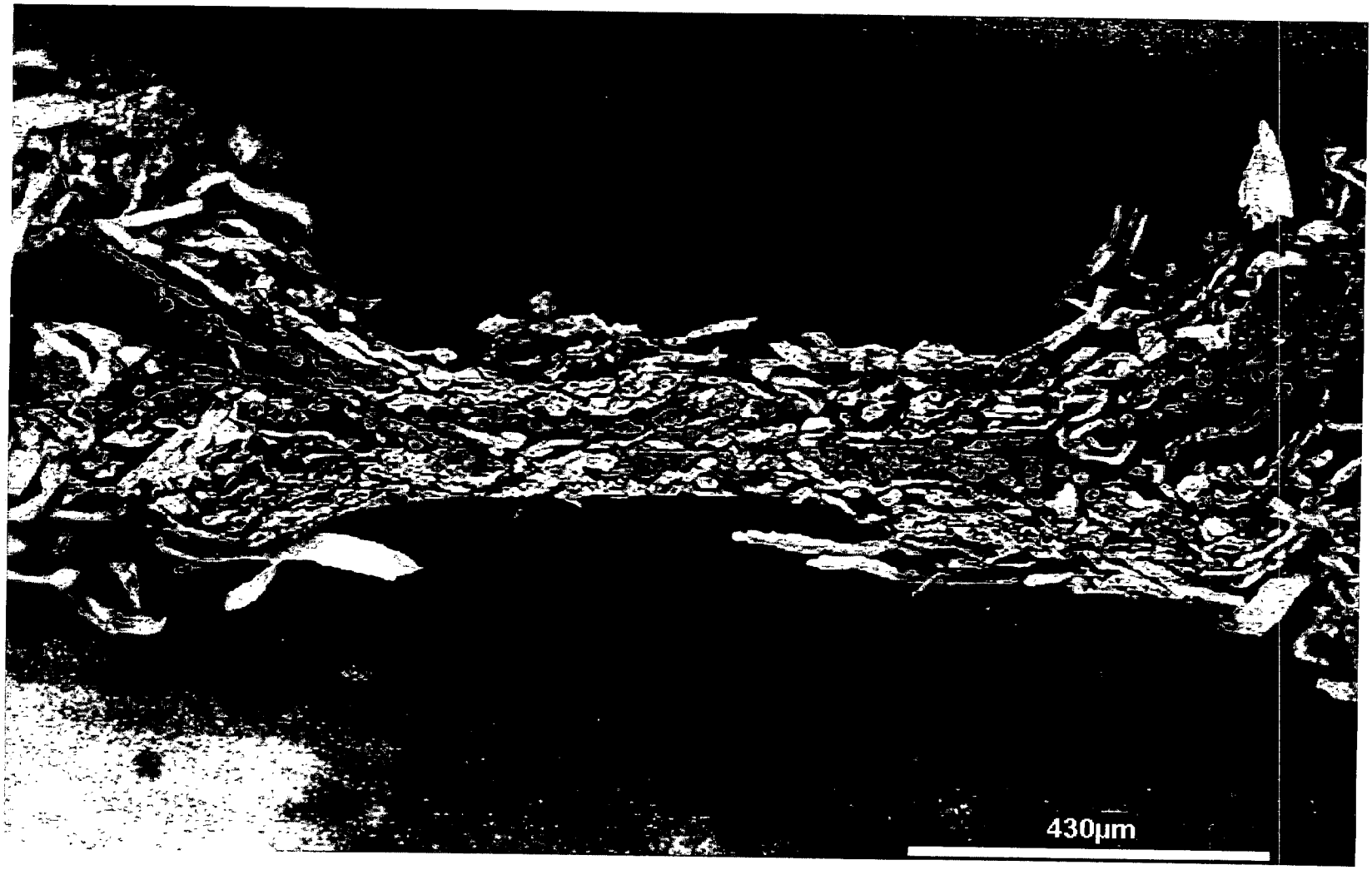
FIG. 4 is an SEM image of a cross-sectional view of an exemplary ultrasonic bond between two plies of hydraulically entangled composite materials containing thermoplastic filaments and pulp fibers.

FIG. 3 shows an example of an ultrasonically bonded region in a web of polypropylene spunbond fibers. It can be seen that a substantially polymer-filled bond region is formed; having substantially no porosity and substantially no void volume. FIG. 4, however, shows an example of an ultrasonically bonded region in the nonwoven fabric of the present invention. It can be seen that, while there is bonding between individual thermoplastic fibers, there is no substantially polymer-filled bonded region formed in the treated area. There is porosity evident at the surface of the bonded region, and the bonded region has void volume throughout the z-direction, i.e., perpendicular to the surface of the nonwoven fabric, of the bonded region. This porosity and void volume allows liquids to enter the wiper at the surface of the bonded region and to travel laterally through the bonded region to the high capacity areas of the wiper between the bonded regions.

The bonded regions between the composite layers desirably provide sufficient strength to reduce the probability of delamination during use. A peel strength test is used to determine the bond strength between component layers of bonded or laminated fabrics. Desirably, the peel strength ranges from about 50 grams to about 500 grams. More desirably, the peel strength ranges from about 50 grams to about 300 grams, and even more desirably the peel strength ranges from about 50 grams to about 200 grams. The capability to achieve desirable peel strengths without the formation of substantially polymer-filled bond points also provides an improved feel to the wiper material that manifests itself in increased drapability and/or softness. Although the inventors do not wish to be held to a particular theory of operation, it is believed that this is due to the lack of polymer-filled bonded regions and to the increased freedom that the pulp fibers have to move within the bonded regions. Because there is no polymer-filled bonded region, the pulp fibers are not substantially occluded within the bonded region. This results in improved drapability, softness, and/or handfeel.

Thus, the nonwoven fabrics of the present invention are produced utilizing an ultrasonic bonding process that provides sufficient ply strength, yet yields an open structure within the bonded regions. The structure is open in all three dimensions. It allows flow not only from the outside of the bonded region to the inside of the bonded region, i.e., the z-direction, but also allows flow laterally in the x- and y-directions. The process also provides a softness, hand and/or drape that otherwise is not found in thermally bonded materials. Desirably, these properties are achieved through selection and use of high ultrasonic power output, high linespeed, and low nip pressure. High ultrasonic power output allows the energy to penetrate the composite layers and fuse the thermoplastic fibers in the middle region of the nonwoven fabric. High linespeed reduces dwell time and reduces the potential for excessive bonding that can result in burning and/or hole formation. Low nip pressure reduces the compression of the fibers within the bonded regions and avoids the complete loss of voids as well.

Ultrasonic lamination of the composite layers can result in a distinctive sidedness to the resulting nonwoven fabric. During lamination, the patterned anvil roll provides a rough surface texture to the side of the laminated material that contacts the patterned anvil roll during the bonding step. This surface texture can aid in the scrubbing, removal and entrapment of debris from a surface being cleaned. The rough surface texture also provides a larger surface area with a repetitive textured geometry that aids in the removal and entrapment of high viscosity liquids onto the surface of the nonwoven fabric and facilitates wicking into the surface of the nonwoven fabric. From the surface of the nonwoven fabric, the liquids can then be absorbed in the z-direction into the center core of the nonwoven fabric. Nonwoven fabrics that have not been laminated or embossed can exhibit a relatively smooth texture on both sides of the material that does not provide this attribute.

The materials of the present invention are not limited to any specific pattern design or geometry. Any number of design patterns are available that provide sufficient points or areas to allow the thermoplastic material to melt, flow, bond and solidify. Patterns can be chosen that provide desirable visual appearance, for non-limiting example, a cloth-like appearance. Exemplary patterns include, but are not limited to, those taught in U.S. Pat. No. D369,907 to Sayovitz et al., U.S. Pat. No. D428,267 to Romano III et al., and U.S. Pat. No. D428,710 to Romano III et al., the entire contents of each of the aforesaid reference being incorporated herein by reference.

It may be desirable to use finishing steps and/or post treatment processes to impart selected properties to the layered nonwoven fabric after the composite layers are bonded together. For example, the fabric may be lightly pressed by calender rolls, creped or brushed to provide a uniform exterior appearance and/or certain tactile properties. Alternatively and/or additionally, chemical post-treatments such as, adhesives or dyes may be added to the fabric.

The nonwoven fabric of the present invention is particularly useful as a wiper material. An exemplary wiper material desirably has a basis weight ranging from about 40 gsm to about 300 gsm. More desirably, exemplary wiper materials have basis weights ranging from about 40 gsm to about 50 gsm, from about 50 gsm to about 60 gsm, from about 60 gsm to about 75 gsm, from about 75 gsm to about 100 gsm, from about 100 gsm to about 150 gsm, from about 150 gsm to about 200 gsm, or from about 200 gsm to about 250 gsm. Even more desirably, an exemplary wiper material has a basis weight ranging from about 120 gsm to about 130 gsm. The wipers can be of any size, and the size can be selected as appropriate for a variety of wiping tasks. An exemplary wiper desirably has a width from about 8 centimeters to about 100 centimeters, more desirably has a width from about 10 to about 50 centimeters, and even more desirably has a width from about 20 centimeters to about 25 centimeters. An exemplary wiper desirably has a length from about 10 centimeters to about 200 centimeters, more desirably has a length from about 20 centimeters to about 100 centimeters, and even more desirably has a length from about 35 centimeters to about 45 centimeters. The wipers can be packaged in a variety of forms, materials and/or containers, including, but not limited to, rolls, boxes, tubs, flexible packaging materials, and so forth. The packages desirably contain from about 10 to about 500 wipers per package, and more desirably contain from about 50 to about 200 wipers per package. The wipers within a package may be folded in a variety of ways, including, but not limited to interfolded, C-folded, and so forth.

The nonwoven fabric of the present invention is also useful as a substrate for a pre-moistened wiper material. The nonwoven fabric can be treated with a liquid such as, by way of nonlimiting example, water, waterless hand cleaner, or other suitable liquid. The liquid may contain, by way of nonlimiting example, antiseptics, fire retardants, surfactants, emollients, humectants, and so forth. Many liquids and ingredients appropriate for use in wet wiper applications are known to those skilled in the art. When fully saturated the contiguous voids within the bonded regions of the pre-moistened wiper material may also be at least partially filled with the liquid, and may even be entirely filled with the liquid.

Test Procedures

Basis Weight: The basis weights of samples were determined essentially in accordance with ASTM D3776-96 with the following change: sample size was 5 inches by 5 inches square.

Bulk: The bulks of samples were determined essentially in accordance with TAPPI Test Method T411om-89. The relative sheet caliper (single ply thickness) was determined using an Emveco controlled loading micrometer, model number 200-A available from Emveco Inc. of Newberg, Oreg., USA. The loading pressure used was 2.0 kilopascals (kPa), and the pressure foot diameter was 56.42 millimeters. The pressure foot lowering rate was 0.8 millimeters per second and the dwell time was about 3 seconds.

Oil & Water Rate: The test determines the rate at which a specimen of absorbent material will absorb liquid by measuring the time required for the material to completely absorb 0.1 milliliters of liquid. In the test three drops are placed on one side of the material and the time for complete absorption is recorded. The average of the three times is reported for each specimen. The sample side is reversed and the test is repeated so that both sides of the material are tested. The test was performed using both motor oil (10W30) and water.

Oil & Water Capacity: The absorptive capacity refers to the capacity of a material to absorb liquid over a period of time and is related to the total amount of liquid held by a material at its point of saturation. Absorptive capacity is determined by measuring the increase in the weight of a material sample resulting from the absorption of a liquid. Absorptive capacity for both water and motor oil (10W30) were tested. Four inch x four inch samples were weighed and then submerged in liquid for five minutes, after which they were removed and hung to drain. Samples submerged in water were allowed to drain for three minutes. Samples submerged in motor oil were allowed to drain for 5 minutes. After draining, the samples were weighed again. Absorptive capacity may be expressed, in percent, as the weight of liquid absorbed divided by the weight of the sample by the following equation:

$$\text{Total Absorptive Capacity}=[(\text{Saturated Sample Weight}-\text{Sample Weight})/\text{Sample Weight}]\times 100$$

Abrasion: Abrasion resistance testing was conducted essentially in accordance with ASTM D3884 using a Taber Double Head Rotary Abraser, model number 5130 available from Taber Industries of North Tonawanda, N.Y., USA. The abrasion test determines the resistance of a fabric to abrasion when subjected to a repetitive rotary rubbing action under controlled pressure and abrasive action. The samples were mounted in a specimen holder, model number E140-15 also available from Taber Industries. The samples were subjected to the sliding rotation of two 6.3 inch diameter ceramic abrading wheels, model number H-18 abrading wheels also available from Taber Industries, rotating at 70 RPM with no additional weights added to the abrading wheels. The abrasion test measured the number of cycles needed to form a 0.5 inch hole through the material for both wet and dry samples.

Drape: The drape stiffness of samples was measured essentially in accordance with ASTM D1388 except that the sample size was 1 inch by 8 inches.

Trapezoid Tear: Trapezoidal tear strengths of samples were measured essentially in accordance with ASTM D1117-14 except that the tearing load was calculated as an average of the first and the highest peak loads rather than an average of the lowest and highest peak loads.

Grab Tensile: Grab tensile strengths of samples were measured essentially in accordance with ASTM D5034-90. Tensile strength measurements of samples were made utilizing an Instron Model 1122 Universal Test Instrument, available from Instron Corporation of Canton, Mass., USA. Tensile strength refers to the maximum load or force (i.e., peak load) encountered while elongating the sample to break. Measurements of peak load were made in the machine and cross-machine directions. The results are expressed in units of force (grams) for samples that measured 4 inches wide by 6 inches long (extension direction).

Peel Strength Test: Peel strengths were determined essentially in accordance with ASTM D2724.13. The procedure was intended to determine the z-direction strength (bond strength) of laminated fabrics. The efficiency of bonding between component layers of a fabric was determined by measuring the force required to delaminate the fabric. Delamination is defined as the separation of the plies of a laminated fabric due to a failure of the bonding mechanism. Peel strength is the tensile force required to separate the component layers of a textile under specified conditions. In this procedure, the plies of a six inch by two inch specimen (six inches in the machine direction) were manually separated for a distance of about two inches along the length of the specimen. One layer was then clamped into each jaw of a tensile testing machine with a gauge length of one inch and the maximum force (i.e., peak load) needed to completely separate the component layers of the fabric was determined. Seven specimens are tested from each sample and the average peak load calculated. Results are expressed in units of force. Higher numbers indicate a stronger, more highly bonded fabric.

EXAMPLES

A two-layer ultrasonically bonded nonwoven fabric according to the present invention was made for comparison to an unbonded single ply wiper material. Each composite layer of the 2-ply nonwoven fabric included about 14 gsm of polypropylene spunbond fibers and about 53 gsm of Northern Softwood Kraft pulp fibers. Each composite layer was made in accordance with U.S. Pat. No. 5,284,703 to Everhart et al. wherein one surface of the composite layer had a preponderance of polypropylene spunbond fibers and the opposite surface had a preponderance of pulp fibers. The two composite layers were directed through an ultrasonic laminator with the surfaces having a preponderance of polypropylene spunbond fibers facing together to form an about 134 gsm nonwoven fabric having surfaces with a preponderance of pulp fibers. The laminator was a Branson Ultrasonic unit, model number 2000BDC available from Branson Ultrasonic Corporation of Danbury, Conn., USA, having 9 inch stationary horns. The two composite layers were bonded together using a patterned anvil roll having the pattern described in U.S. Pat. No. D428,267 to Romano III et al. The power output from the horns was set to maximum power level, while the linespeed was increased to about 85 meters per minute to prevent burning. Pressure within the nip was minimized by adjusting the gap between the ultrasonic horn and the patterned anvil roll to achieve sufficient peel strength while preventing over-compression of the bonded regions. The single ply material used for comparison is an about 135 gsm hydroentangled composite containing about 29 gsm of polypropylene spunbond fibers and about 106 gsm of pulp fibers made in accordance with U.S. Pat. No. 5,284,703.

Table 1 provides a comparison of the two materials. It can be seen from Table 1 that the two-layer nonwoven fabric provides increased absorbency measured by both absorption rate and absorbent capacity for both water and oil. The two-layer nonwoven fabric also provides improved tactile properties indicated by an increase in bulk and a reduction in drape. Properties indicative of durability, i.e., abrasion resistance, tear strength, and tensile strength, are substantially similar between the two samples.

TABLE 1

Two-layer vs. Single Layer

| Property | Two-layer | Single Layer |
|---|---|---|
| Basis Weight (gsm) | 134.9 | 134.5 |
| Percent Pulp | 78.8 | 78.3 |
| Percent Polypropylene | 21.2 | 21.7 |
| Bulk (in) | .0320 | .0233 |
| Motor Oil Rate (seconds) | 25 | 78 |
| Motor Oil Capacity (grams) | 6.0 | 4.3 |
| Water Rate (seconds) | 0.70 | 1.05 |
| Water Capacity (grams) | 6.9 | 4.85 |
| Abrasion, dry (cycles) | 212 | 175 |
| Abrasion, wet (cycles) | 226 | 313 |
| Peel Strength, md (grams) | 92 | N/A |
| Peel Strength, cd (grams) | 91 | N/A |
| Drape, md (cm.) | 3.4 | 3.9 |
| Drape, cd (cm.) | 2.5 | 2.9 |
| Tear, md (lbs) | 6.4 | 6.9 |
| Tear, cd (lbs) | 3.3 | 4.8 |
| Tensile, md (lbs) | 21.5 | 25.6 |
| Tensile, cd (lbs) | 16.6 | 19.0 |

While the invention has been described in detail with respect to specific embodiments thereof, and particularly by the example described herein, it will be apparent to those skilled in the art that various alterations, modifications and other changes may be made without departing from the spirit and scope of the present invention. It is therefore intended that all such modifications, alterations and other changes be encompassed by the following claims.

We claim:

1. A nonwoven fabric comprising:

a first composite layer, said first composite layer comprising from about 50% to about 90% by weight non-thermoplastic absorbent staple fibers and from about 10% to about 50% by weight thermoplastic fibers, wherein a preponderance of the fibers at a first outer surface of the first composite layer comprise non-thermoplastic absorbent staple fibers, and further wherein a preponderance of the fibers at a second outer surface of the first composite layer comprise thermoplastic fibers, a second composite layer, said second composite layer comprising from about 50% to about 90% by weight non-thermoplastic absorbent staple fibers and from about 10% to about 50% by weight thermoplastic fibers, wherein a preponderance of the fibers at a first outer surface of the second composite layer comprise non-thermoplastic absorbent staple fibers, and further wherein a preponderance of the fibers at a second outer surface of the second composite layer comprise thermoplastic fibers, and further wherein said second outer surface of the second composite layer is adjacent said second outer surface of the first composite layer, and, bonded regions wherein a portion of said thermoplastic fibers of the first composite layer are fused to a portion of said thermoplastic fibers of the second composite layer, and further wherein said bonded regions have a plurality of contiguous voids.

2. The nonwoven fabric of claim 1 wherein said bonded regions comprise discrete bond points.

3. The nonwoven fabric of claim 1 wherein said bonded regions are substantially porous in the z-direction.

4. The nonwoven fabric of claim 1 wherein said contiguous voids allow substantial flow of absorbed liquids within the bonded regions.

5. The nonwoven fabric of claim 1 wherein said bonded regions are substantially porous in the x- and y-directions.

6. The nonwoven fabric of claim 1 wherein said bonded regions are substantially porous in the x-, y-, and z-directions.

7. The nonwoven fabric of claim 1 wherein the nonwoven fabric has a peel strength ranging from about 50 grams to about 500 grams.

8. The nonwoven fabric of claim 1 wherein the nonwoven fabric has a peel strength ranging from about 50 grams to about 300 grams, and further wherein the nonwoven fabric has a basis weight ranging from about 40 gsm to about 300 gsm.

9. The nonwoven fabric of claim 1 wherein said bonded regions are ultrasonically bonded.

10. The nonwoven fabric of claim 1 wherein the non-thermoplastic absorbent staple fibers comprise pulp fibers.

11. The nonwoven fabric of claim 1 wherein the thermoplastic fibers comprise substantially continuous filaments.

12. The nonwoven fabric of claim 1 wherein the thermoplastic fibers comprise polypropylene fibers.

13. A nonwoven fabric comprising:

a first composite layer, said first composite layer comprising from about 50% to about 90% by weight absorbent pulp fibers and from about 10% to about 50% by weight substantially continuous polypropylene filaments, wherein said absorbent pulp fibers and said substantially continuous polypropylene filaments within the first composite layer are entangled together, and further wherein a preponderance of the fibers at a first outer surface of the first composite layer comprise absorbent pulp fibers, and further wherein a preponderance of the fibers at a second outer surface of the first composite layer comprise substantially continuous polypropylene filaments, a second composite layer, said second composite layer comprising from about 50% to about 90% by weight absorbent pulp fibers and from about 10% to about 50% by weight substantially continuous polypropylene filaments, wherein said absorbent pulp fibers and said substantially continuous polypropylene filaments within the second composite layer are entangled together, and further wherein a preponderance of the fibers at a first outer surface of the second composite layer comprise absorbent pulp fibers, and further wherein a preponderance of the fibers at a second outer surface of the second composite layer comprise substantially continuous polypropylene filaments, and further wherein said second outer surface of the second composite layer is adjacent said second outer surface of the first composite layer, and, bonded regions wherein a portion of said substantially continuous polypropylene filaments of the first composite layer are fused to a portion of said substantially continuous polypropylene filaments of the second composite layer, and further wherein said bonded regions have a plurality of contiguous voids, wherein the nonwoven fabric has a peel strength ranging from about 50 grams to about 500 grams.

14. The nonwoven fabric of claim 13 wherein said bonded regions are substantially porous in the z-direction.

15. The nonwoven fabric of claim 13 wherein said bonded regions are ultrasonically bonded.

16. A wiper comprising the nonwoven fabric of claim 13, the nonwoven fabric having a basis weight ranging from about 40 gsm to about 300 gsm.

* * * * *